US005841065A

United States Patent [19]

Mendenhall

[11] Patent Number: 5,841,065

[45] Date of Patent: Nov. 24, 1998

[54] GAS GENERANTS CONTAINING ZEOLITES

[75] Inventor: Ivan V. Mendenhall, Providence, Utah

[73] Assignee: Autoliv ASP, Inc., Ogden, Utah

[21] Appl. No.: 834,182

[22] Filed: Apr. 15, 1997

[51] Int. Cl.[6] ..... C06B 33/00; C06D 5/06

[52] U.S. Cl. ..... 149/37; 102/289; 102/290

[58] Field of Search ..... 102/288–290; 149/17, 37

[56] References Cited

U.S. PATENT DOCUMENTS

| | | | |
|---|---|---|---|
| 4,106,478 | 8/1978 | Highashijima | 126/263 |
| 4,168,363 | 9/1979 | Boettcher | 528/48 |
| 5,019,220 | 5/1991 | Taylor et al. | 264/3.4 |
| 5,223,184 | 6/1993 | Taylor et al. | 264/3.4 |
| 5,437,229 | 8/1995 | Taylor et al. | 102/288 |
| 5,583,315 | 12/1996 | Fleming | 149/19.4 |

OTHER PUBLICATIONS

GSA Resources, Inc., "General Information—Data Sheet 1", pp. 1–5, no date given.

GSA Resources, Inc., "Cation–Exchange Capacity of Zeolites", pp. 1–4, no date given.

*Primary Examiner*—Peter A. Nelson

*Attorney, Agent, or Firm*—Sally J. Brown

[57] ABSTRACT

In a gas generant composition containing a source of ammonia, such as an ammonium salt or an ammonia-transitional metal complex that emits ammonia as a degradation product, a zeolite, particularly chabazite, is added as an ammonia-absorbing material. In gas generant formulations containing a copper compound and a nitrate source, the zeolite acts to reduce or prevent formation of copper tetrammine dinitrate.

4 Claims, No Drawings

GAS GENERANTS CONTAINING ZEOLITES

The present invention is directed to gas generant formulations in which ammonia may be evolved from one or more components of a such a gas generant formulation as a degradation product, and particularly to such gas generant formulations in which ammonia may interact with other components of a gas generant composition to produce a product which is either unstable or which significantly affects the burn rate of the gas generant formulation.

BACKGROUND OF THE INVENTION

It has been found that when a gas generant formulation is severely heat-aged, which gas generant contains an ammonia source, such as an ammonium salt or ammonia complexed with a transition metal or transition metal compound, ammonia can be released. This release may affect the burn rate of the gas generant formulation, either positively or negatively, a result which is undesirable because gas generant formulations in automotive airbag inflators should burn at a predictable rate. Ammonia may also complex with transition metals, particularly copper, or other components of the gas generant formulations, producing undesirable chemical species. It is a primary objective of the present invention to provide, in a gas generant that contains an ammonia liberating species, a material that absorbs ammonia as a harmless product.

SUMMARY OF THE INVENTION

In accordance with the present invention, in a pyrotechnic gas generant formulation having a fuel and an oxidizer at 100 parts by weight total and which includes a component which evolves ammonia upon degradation, the gas generant formulation is improved by addition of between about 0.5 and about 10 parts of a zeolite, preferably chabazite, which absorbs ammonia.

DETAILED DESCRIPTION OF CERTAIN PREFERRED EMBODIMENTS

Gas generant formulations proposed for automotive airbags or the like may contain a compound, such as an ammonium salt or an ammonia-transition metal complex, which evolves ammonia as a degradation product. Generally, the ammonia source will be the fuel, but the ammonia source could be the oxidizer or an additional additive component of the gas generant formulation. An example of an ammonium salt used in automotive airbag gas generant formulations is diammonium bitetrazole (DABT), used as a fuel. An example of an ammonia-transition metal complex used in automotive airbag gas generant formulations is hexammine cobalt (III) nitrate, used as a fuel. Ammonia is a noxious gas which is an undesirable component of the gaseous mixture which inflates automotive airbags; hence, the desire to reduce or eliminate ammonia which may be evolved from a gas generant formulation by degradation of one or more of the components.

Also, it is found that in gas generant formulations containing a copper compound, e.g., as an oxidizer such as CuO, an ammonia-evolving compound, and a nitrate, e.g., as an additional oxidizer, copper tetrammine dinitrate may form. Formation of copper tetrammine dinitrate appears to be enhanced if a copper-complexing compound is also included in the gas generant formulation, such as an organic acid, tartaric acid being an example. Copper tetrammine dinitrate is undesirable because it appears to significantly affect the burn rate of the gas generant formulation, enhancing the burn rate in some gas generant formulations and repressing the burn rate in other gas generant formulations. Because gas generant formulations are carefully formulated to provide a particular burn rate for a particular airbag application, changes in burn rate over time are considered to be disadvantageous. Accordingly, there is a desire to prevent evolution of ammonia from any of the gas generant formulations from forming copper tetrammine dinitrate.

In accordance with the invention, a zeolite, most particularly chabazite, is added to the gas generant at between about 0.5 and about 10 parts by weight relative to 100 parts by weight total fuel plus oxidizer, so as to absorb ammonia, thereby reducing the amount of ammonia present as a noxious component of airbag-inflating gases produced by the gas generant formulation and/or preventing formation of undesirable ammonia complexes, such as copper tetrammine dinitrate.

Zeolites are crystalline, hydrated aluminosilicates of alkali and alkaline earth metals, having infinite, three-dimensional structure. Of available zeolites, chabazite is preferred for its availability and for its ammonia-absorbing ability. However, other ammonia-absorbing zeolites or mixtures of ammonia-absorbing zeolites may be used, including, but not limited to clinoptilolite, mordenite, eronite, phillipsite, analcime, laumonite, natrolite, faujasite, synthetic zeolite A ($(Na_{12})(Al_{12}Si_{12}O_{48})\cdot 27H_2O$) and synthetic zeolite B ($(Na_{86})(Al_{86}Si_{106}O_{384})\cdot 264H_2O$).

Zeolites have the further advantageous property of absorbing water which might inadvertently be present as water vapor or which might be evolved from one of the components of the gas generant formulation as a degradation product.

EXAMPLE

A control gas generant formulation* was formulated as follows:

40.3% basic copper nitrate 38.2% hexammine cobalt (III) nitrate 15.7% guanidine nitrate 5.7% guar gum

*A patented Thiokol, Corp. formulation

To this gas generant formulation was added, in accordance with the invention, 7.5 parts by weight chabazite relative to 100 parts fuel plus oxidizer. A portion of the control gas generant formulation and the chabazite-containing formulation were heat-aged at 107° C. for 400 hours. In this case, burn rate in the control sample was depressed by heat-aging, but the addition of chabazite to the formulation substantially maintained the burn rate of the non-heat-aged control sample. Burn rates of the control, the heat-aged control and heat-aged composition in accordance with the invention were given at various pressures, the results being given in the Table below:

TABLE

| | Burn Rate (inches/second) | | | |
|---|---|---|---|---|
| Treatment | 1000 psi | 1500 psi | 2000 psi | 3000 psi |
| No heat age | 0.488 | 0.554 | 0.606 | 0.687 |
| Heat age with chabazite | 0.468 | 0.540 | 0.598 | 0.690 |
| Heat age w/o chabazite | 0.305 | 0.359 | 0.403 | 0.475 |

It is to be appreciated that the heat-age conditions described in the above examples are much more severe than a gas generant formulation would ever be expected to experience in normal automotive use. Nevertheless, in the interest of providing a predictable inflator burn rate over the life of the vehicle, the addition of the zeolite represents an important improvement.

What is claimed is:

1. In a gas generant formulation comprising 100 parts by weight of fuel plus oxidizer, said gas generant formulation containing a compound which evolves ammonia as a degradation product, the improvement wherein said gas generant formulation further comprises between about 0.5 and about 10 parts by weight of chabazite.

2. In a gas generant formulation in accordance with claim 1 comprising a copper compound and a nitrate source, whereby said zeolite inhibits the formation of copper tetrammine dinitrate.

3. In a gas generant formulation according to claim 2 wherein said gas generant formulation comprises a copper-complexing compound.

4. In a gas generant formulation according to claim 3, wherein said copper-complexing compound is an organic acid.

* * * * *